United States Patent [19]

O'Rourke

[11] Patent Number: 4,815,507

[45] Date of Patent: Mar. 28, 1989

[54] SOCKET MOUNTED PENCIL SHARPENER FOR COSMETIC FACIAL PENCIL

[76] Inventor: Dianne L. O'Rourke, General Delivery, Providenciales, Turk & Caccos Islands, Cocos (Keeling) Isls.

[21] Appl. No.: 197,509

[22] Filed: May 23, 1988

[51] Int. Cl.[4] ..... B43L 23/02

[52] U.S. Cl. ..... 144/28.5; 51/170 PT; 51/73 R; 144/28.1

[58] Field of Search ..... 51/73 R, 170 PT; 144/28.1, 28.4, 28.5

[56] References Cited

U.S. PATENT DOCUMENTS

| | | | |
|---|---|---|---|
| 3,004,522 | 10/1961 | Kent | 144/28.5 |
| 3,889,730 | 6/1975 | Buc | 144/28.5 |
| 4,050,487 | 9/1977 | Mabuchi et al. | 144/28.5 |
| 4,513,798 | 4/1985 | Luttgens | 144/28.1 |

*Primary Examiner*—W. Donald Bray
*Attorney, Agent, or Firm*—John Cyril Malloy

[57] ABSTRACT

A portable, light-weight pencil sharpener specifically designed to sharpen cosmetic pencils of the type commonly known as "eye brow" pencils and including a housing enclosing a blade structure and an electrically powered drive motor wherein the housing and power connecting structure are cooperatively dimensioned and disposed to mount the housing directly on a wall outlet or socket during operation.

9 Claims, 1 Drawing Sheet

SOCKET MOUNTED PENCIL SHARPENER FOR COSMETIC FACIAL PENCIL

BACKGROUND OF THE INVENTION

1. Field of the Invention

This invention relates to a portable pencil sharpener being electrically powered and designed primarily, but not necessarily exclusively for the sharpening of cosmetic pencils used in the applying of facial make-up.

2. Description of the Prior Art

Sharpening devices used to sharpen points onto writing pencils have been in use and known for many years. Such prior art devices vary from relatively simple hand-manipulated sharpeners to relatively complicated, more sophisticated electrically-powered devices. The powered pencil sharpeners are known to be powered both from a conventional A.C. electrical power supply, as a wall outlet or alternately by batteries.

While each of the aforementioned types of sharpening devices are applicable for a common writing pencil, regardless of the softness of the writing material core, such is not necessarily true for cosmetic pencils of the type conventionally used to apply facial make-up. Typically, cosmetic pencils have a much softer material central core running along the length thereof. It has been found therefore, that manually operated sharpening devices, almost regardless of their configuration or structure, still have a tendency to break or rapidly deteriorate the points on such cosmetic pencils during the sharpening process. To the contrary, it has been found that "powered" sharpening assemblies have a "smoother" operation and frequently sharpen such cosmetic pencils to a point without as much breakage. Naturally, most prior art powered sharpening assemblies or "pencil sharpeners" are not adequately structured in terms of configuration, dimension, etc. to carry in an average cosmetic case or the like.

The U.S. Pat. No. 4,513,798 to Luttgens discloses a sharpener specifically for cosmetic sticks as well as other types of "writing sticks". The structure disclosed in this patent, however, is clearly manually operated and is absent any power drive mechanism. Accordingly, while it is presumed the structure disclosed therein is applicable for its intended function, there is a question as to whether such a sharpening device would have the same problems regarding easy breakage of the relatively soft core of a cosmetic pencil even in light of the allegations made in this patent.

Additional prior art devices which are "electrically powered" but driven by batteries carried with the housing of the subject sharpening assemblies are taught in the following U.S. Pat. Nos. 3,004,522; to Kent, Buc, 3,889,730 and Mabuchi, 4,050,487.

Even in light of the prior art devices well known in the industry and of the type disclosed in the above set forth patents, there is still a need for a pencil sharpening device which is light-weight, portable, not powered by batteries yet electrically powered from a conventional source which is readily carryable by the user thereof without the need of an accompanying electric cord and plug used to fit conventional wall outlets.

SUMMARY OF THE INVENTION

The present invention relates to a sharpening assembly more commonly known to the general consumer or user as a "pencil sharpener" of the type which is capable of sharpening to a point, one end of almost any type of writing pencil but which is primarily designed for the sharpening of cosmetic pencils of the type used to apply facial make-up and also commonly known as "eye brow pencils". Typically, such make-up or cosmetic pencils have a much softer core than the conventional writing pencil. These cores, because of the softness of the material utilized are more subject to breaking or crumbling not only during use or storage but also during the sharpening process. It has been found that manually rotatable sharpeners having a relatively simple design, while functional to sharpen cosmetic pencils of the type referred to herein, frequently do not perform best in terms of preventing breakage or deterioration of the sharpened end of the cosmetic pencil.

To the contrary, the present invention is directed to a portable, light-weight, electrically powered sharpening assembly which is non-battery operated but also which is specifically structured to eliminate any elongated electrical insulated cord and plug thereby rendering the subject sharpening assembly more feasible for carrying in a relatively small cosmetic case or the like.

The sharpening assembly of the present invention comprises a housing having a generally hollow interior portion in which an electrically powered drive motor is mounted. The drive motor of course may be of very small proportion and is specifically structured to rotatably drive a blade means. The blade means in turn is cooperatively disposed relative to an access opening in the housing such that an appropriate end of a pencil is placed through the access opening into the interior of the housing and into direct contact with the blade means. Activation by an appropriate switching means serves to allow current flow to the drive motor and operate the blade means so as to sharpen the appropriate end of the pencil in contact therewith.

An important feature of the present invention is the provision of a power connection means serving to electrically interconnect the drive motor to a source of electricity. The source of electricity utilized is a conventional 110 volt power source used in most domestic or commercial buildings. Also an important feature of the present invention is the power connection means being in the form of at least two electrical conductor mounting prongs of the type which fit into the spaced-apart receiving apertures in a wall outlet or socket of conventional design. Such conductor prongs protrude outwardly from a rear face or surface of the housing and are rigidly connected to the housing. The rear surface of the housing as well as the disposition and structure of the prongs themselves allows the housing to be maintained and supported effectively on the socket in somewhat depending and cantilevered relation thereto during the sharpening of the pencil placed through the axis opening into contact with the blade means.

Another feature of the present invention includes the provision of a storage chamber removably or otherwise at least partially disposable relative to the housing. The storage chamber is disposed in receiving relation to cuttings falling from the blade means and being removed from the sharpened end of the pencil placed into cutting engagement with the blade means. Various embodiments of the storage chamber includes its removable mounting attachment to the housing so as to allow it to be completely removed for emptying or selectively positionable between an open and closed position wherein the open position clearly allows the contents thereof, such as the collected cuttings, to be emptied into a waste area.

The invention accordingly comprises the features of construction, a combination of elements, an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
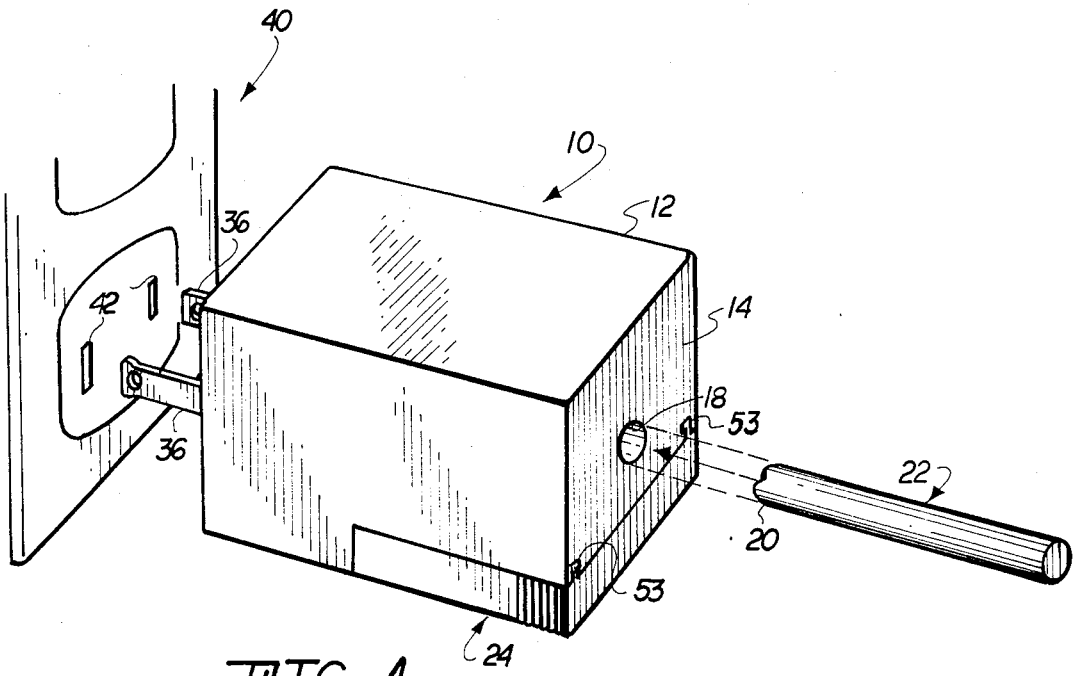
FIG. 1 is a perspective view in partial cut-away of the sharpening assembly of the present invention prior to it being mounted in its preferred supportive relation on a wall socket or outlet.

As shown in the figures accompanying the present invention, the cutting assembly is generally indicated as 10 and includes a housing 12 formed of a light-weight plastic or any other applicable material having a front face 14 and a rear surface 16. The housing includes an access opening 18 preferably formed on either the front surface 14 or any other applicable surface. The access opening 18 is specifically disposed and dimensioned to allow entry of an appropriate one end 20 of a pencil, preferably a cosmetic pencil generally indicated as 22 for the application of facial make-up or the like.

A storage compartment is generally indicated as 24 and is preferably secured to what may be considered a lower portion of the housing as at 26 and in an accessible location relative thereto so that the storage chamber 24 can easily be removed from the housing 12 or disposed in an emptying position as will be described in greater detail hereinafter primarily with regard to FIG. 4. In addition, as clearly shown in FIG. 2, the storage chamber 24 is located preferably beneath a cutting blade means generally indicated as 28 such that cuttings from the appropriate end 20 of the pencil 22 being sharpened falls directly into the interior of the storage chamber 24 as at 30.

The access opening 18 is disposed in direct alignment and communicating relation with the blade means 28 and communicates with a guide channel or slot as at 32 which effectively directs the appropriate end 20' (see FIG. 2) into direct cutting engagement with the blade means 28.

The blade means 28 is driven by a drive motor 32 itself being electrically powered from a conventional source of electricity such as is commonly supplied to conventional homes or commercial buildings. A conventional wall outlet socket generally indicated as 40 has receiving apertures 42 for the receiving of a conventional wall plug associated with numerous other appliances and electrically powered devices. Accordingly, the present invention includes a power connection means generally indicated as 34 at least partially defined by two spaced-apart conductor prongs 36 spaced-apart and dimensioned to be received within the socket apertures 42 of the wall socket 40. The prongs extend outwardly from the rear face or surface 16 of the housing 12 and are electrically connected to any type of preferably miniaturized step down transformer 38. Preferably, the miniaturized transformer 38 is mounted or housed within the housing 12 for purposes of compactness and convenience. The transformer, after stepping down the incoming current, delivers such current to the drive motor 32 under the regulation and control of a switch means generally indicated as 44. The switch means 44 may be either manually or "automatically" activatable and/or positionable between a current-on and a current-off position. The switch means is conducted to the drive motor 32 by any type of conventional conductor as at 33 and also in current receiving relation to the transformer by an appropriate conductor 35 (see FIG. 3). In the embodiments shown in FIG. 2, the switch means 44 is operated "automatically" by insertion of the appropriate end of the 20' (represented in phantom lines). Abutting engagement of one member as a 37 with the incoming end 20' forces the switch member 37 into a closed circuit position with the opposite contact as at 39. When the two contacts 39 and 39' are forced together by the insertion of the appropriate end 20' of the cosmetic pencil 22 as indicated by directional arrow, the drive motor 32 is automatically activated in that current is allowed to flow thereto. The blade means therefore is driven into its rotating movement causing cutting engagement with the end 20' of the cosmetic pencil 22 and a sharpening of such end. The cuttings removed from the end 20 or 20' fall into the interior 30 of the storage chamber 24 and may be removed therefrom when sufficient build-up of cuttings occur or when convenient.

An important feature of the present invention is the cooperative interconnection and structure of the prongs 36 with the housing 12 and more specifically the rear surface thereof 16. The presence of the transformer 38 and its surrounding casing as indicated serves to effectively fix or brace the prongs in the aforementioned position. Also, in a preferred embodiment at least one-half of the rear surface 16 extends below the prongs 36 enabling a fixed supporting engagement of the exterior surface 40' of the wall socket 40 serving to support the rear surface 16 of the housing 12 and allow such supporting engagement in the position shown at least partially in phantom lines in FIG. 2 during the sharpening process and operation of the assembly.

Figure 2:
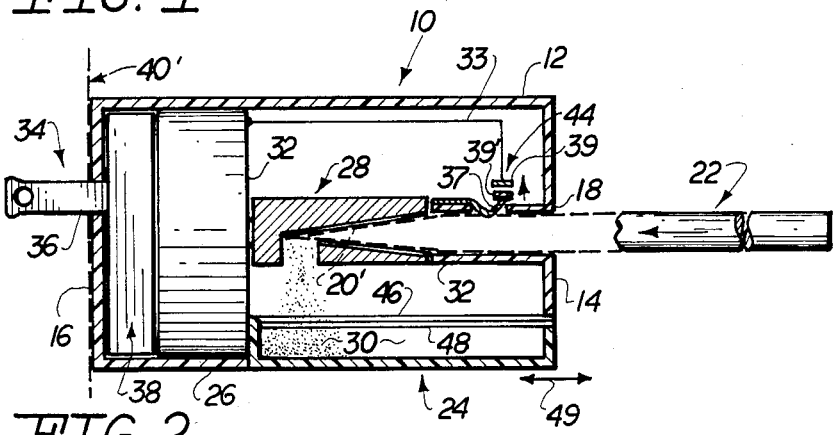
FIG. 2 is a longitudinal sectional view showing interior components of the sharpening assembly mounted within the housing.
Figure 3:
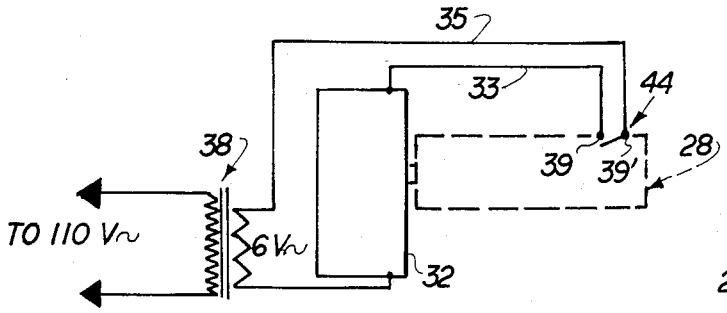
FIG. 3 is a schematic representation of the various components.

With regard to the embodiment of FIGS. 1 and 2, a track means is provided in the form of a first pair of track elements 46 formed on a lower portion of the housing and a similar pair of track elements 48 shown on an upper portion or edge of the storage chamber 24. The respective track elements 46 and 48 define the aforementioned track means such that sliding engagement inwardly and outwardly of the storage chamber may occur in order to completely remove it from the housing and allow it to be emptied as indicated as indicated by the directional arrow 49.

Figure 4:
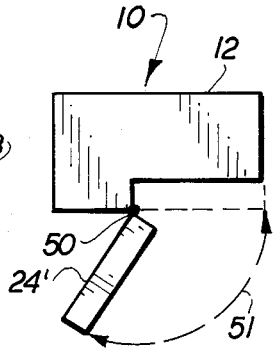
FIG. 4 is a schematic representation of another embodiment wherein a storage chamber for the collection of cuttings is displaceable into an emptying position.

In another embodiment, shown in FIG. 4, there may be a pivotal connection as at 50 serving to interconnect one end portion of the storage chamber 24 to the under portion of the housing 12 wherein detachable lock members 53 (FIG. 1) may be provided to effectively lock the storage chamber 24 into its closed position. However, disengagement of the lock structures 53 allows selective positioning of the storage chamber 24 between its open position for emptying, or its closed position while still being at least partially connected to the housing to allow emptying thereof as indicated by directional arrow 51.

Now that the invention has been described,

What is claimed is:

1. A portable sharpening assembly designed primarily for the sharpening of cosmetic pencils, said sharpening assembly comprising:

a. a housing having a substantially hollow interior and including an electrically powered drive motor mounted thereon, b. blade means mounted within said housing and drivingly connected to said drive motor for sharpening a cosmetic pencil coming into contact therewith, c. said housing including an axis opening disposed in aligned, communicating relation to said blade means and dimensioned and configured to receive and position a head portion of the cosmetic pencil in engaging relation to the blade means, d. a storage chamber mounted on said housing in communicating relation to the blade means and positioned and dimensioned to receive cuttings of the pencil head from the blade means, e. said storage chamber at least partially removably connected to said housing and selectively disposable between an open and a closed position, whereby such storage chamber may be emptied of cuttings received therein, f. power connection means for electrically connecting said drive motor to a source of electricity being secured to said housing and comprising a pair of spaced-apart electrical prongs protruding outwardly from a rear surface of said housing and dimensioned and configured to removably engage a conventional electric wall socket, g. switch means positionable between a current-on and a current-off position and connected in current regulating relation to the drive motor for regulating activation thereof, and h. said housing and said rear surface, thereof dimensioned and disposed to supportingly engage a supporting surface adjacent said wall socket and removably attach and support said housing thereon during operation of said blade means and sharpening of the cosmetic pencil.

2. An assembly as in claim 1 wherein said access opening is disposed on a front face of said housing substantially opposite to said rear surface thereof and configured in substantially axially aligned relation with said blade means and disposed to provide access to said hollow interior portion for one end of the cosmetic pencil.

3. An assembly as in claim 1 wherein said switch means is located adjacent said access opening and in at least partially interruptive relation to the one end of a pencil entering said access opening, said switch means structured for forced positioning into said current-on position when the portion thereof comes into contact with the cosmetic pencil entering said access opening.

4. An assembly as in claim 1 wherein said storage chamber is mounted on an under portion of said housing beneath said blade means and in receiving relation to cuttings from said blade means.

5. An assembly as in claim 4 wherein said storage chamber receives cuttings by gravity fall from said blade means.

6. An assembly as in claim 4 further comprising a track means formed on an under portion of said housing and on a top portion of said storage chamber for sliding engagement therebetween and selective removal of said storage chamber relative to said housing.

7. An assembly as in claim 6 wherein said track means comprises spaced-apart parallel track elements formed on upper longitudinal edges of said storage chamber and cooperative receiving track elements in spaced apart parallel and receiving relation on said housing.

8. An assembly as in claim 4 wherein said storage chamber is pivotally connected to said housing and selectively displaceable between said open position and said closed position while still being connected to said housing.

9. An assembly as in claim 1 wherein said housing and said rear surface extends downwardly from said pair of prongs a distance at least one-half the longitudinal distance of said housing.

* * * * *

UNITED STATES PATENT OFFICE

CERTIFICATE OF CORRECTION

Patent No. 4,815,507 Dated March 28, 1989

Inventor(s) Dianne L. O'Rourke

It is certified that error appears in the above-identified patent and that said Letters Patent is hereby corrected as shown below:

On the title page, the Inventor's address should be corrected to read:

Dianne L. O'Rourke
General Delivery
Providenciales
Turks and Caicos Islands
B.W.I.

Signed and Sealed this

Twenty-seventh Day of February, 1990

*Attest:*

JEFFREY M. SAMUELS

*Attesting Officer* *Acting Commissioner of Patents and Trademarks*